United States Patent [19]

Buck, Jr.

[11] Patent Number: 4,550,050

[45] Date of Patent: Oct. 29, 1985

[54] FIBEROUS BATT

[75] Inventor: George S. Buck, Jr., Memphis, Tenn.

[73] Assignee: Fiberlok, Inc., Memphis, Tenn.

[21] Appl. No.: 579,511

[22] Filed: Mar. 21, 1984

Related U.S. Application Data

[62] Division of Ser. No. 339,627, Jan. 15, 1982, Pat. No. 4,457,793.

[51] Int. Cl.[4] ..... D04H 1/58

[52] U.S. Cl. ..... 428/283; 428/288; 428/510; 428/514; 428/522

[58] Field of Search ..... 428/510, 514, 507, 283, 428/288, 522; 106/181; 526/345, 322.4, 321; 156/283, 333, 62.2, 296

[56] References Cited

U.S. PATENT DOCUMENTS

| | | | |
|---|---|---|---|
| 3,325,344 | 6/1967 | Semancik | 156/333 |
| 3,862,287 | 1/1975 | Davis | 156/283 |
| 3,993,518 | 11/1976 | Buck, Jr. et al. | 428/283 |

*Primary Examiner*—Michael Ball

*Attorney, Agent, or Firm*—Quaintance & Murphy

[57] ABSTRACT

A process for producing a fiberous batt by contacting fibers with particles of a copolymer of vinyl chloride and a diester of a vinyl unsaturated dicarboxylic acid.

2 Claims, 3 Drawing Figures

Fig. 1
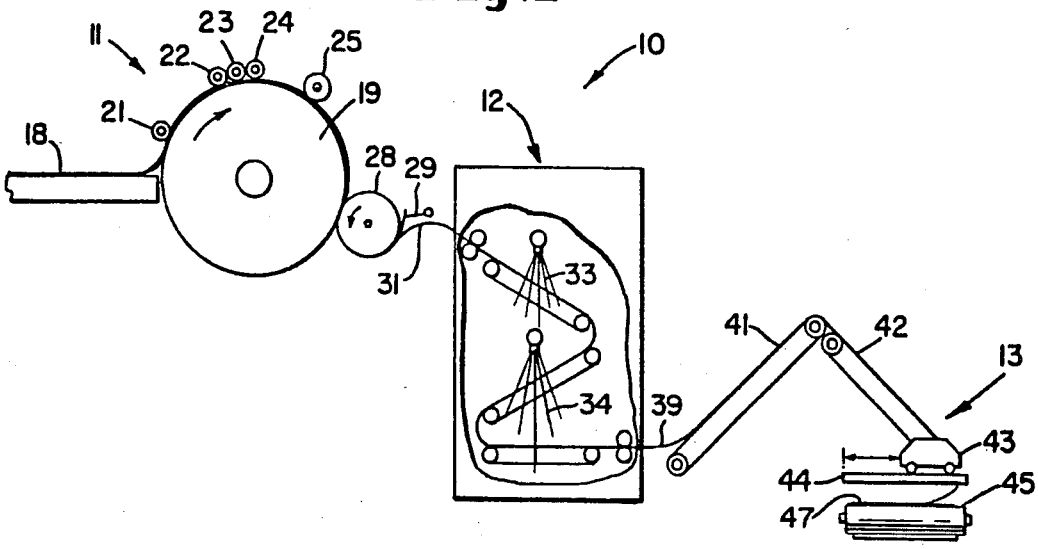
Fig. 2
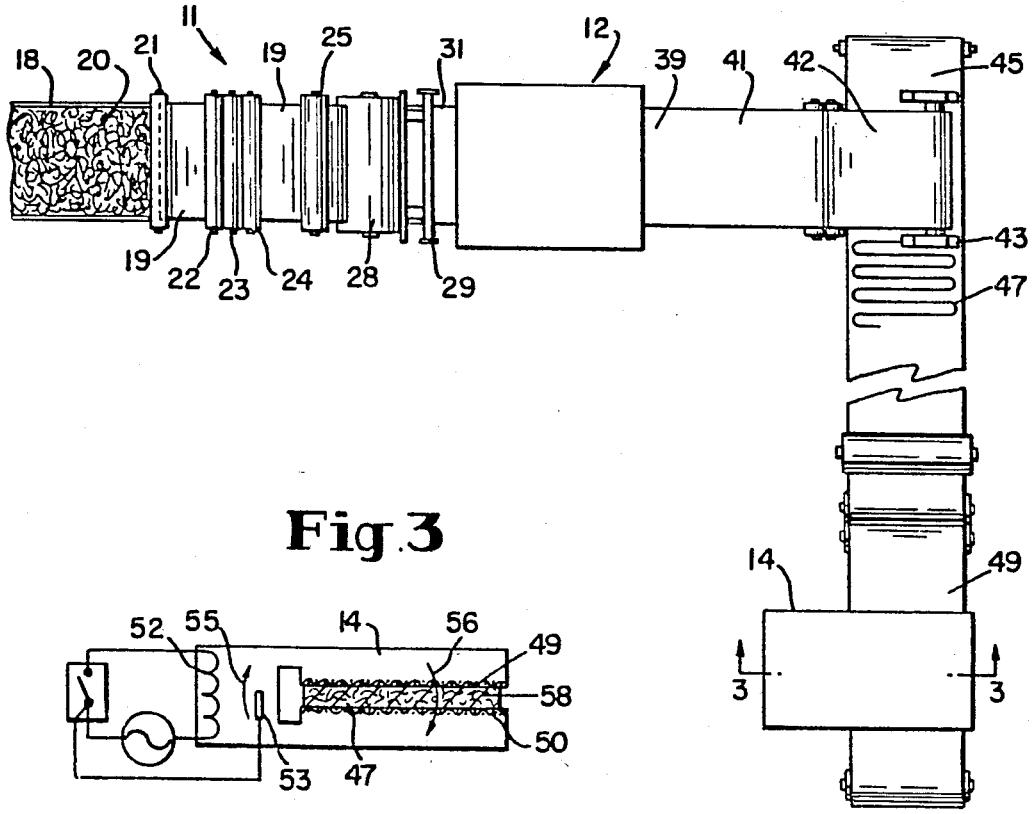
Fig. 3

FIBEROUS BATT

This application is a divisional application of application Ser. No. 339,627, filed Jan. 15, 1982, which is now U.S. Pat. No. 4,457,793.

Some years ago a method was developed for producing a fiberous batt by contacting a thin web of fibers with a bonding agent based on copolymers of vinylidene chloride and vinyl chloride (PVDC-PVC). The process is described in U.S. Pat. Nos. 3,993,518, 4,047,991, 4,050,977, 4,051,294, 4,053,673, and 4,053,674 naming BUCK et al as inventors.

The prior PVDC-PVC copolymer is employed in dry, particulate form, thus avoiding the packing and matting that is caused by using polymers in solution, suspension, or emulsion form, and at the same time eliminating the cost of removing a solvent or aqueous carrier with heat. In this prior process the batt is formed by lapping the thin polymer-containing web upon itself on a moving conveyor until the desired weight of batt is obtained, and thereafter bonding the fiberous batt by subjecting it to heating at a temperature above the melting point of the copolymer and subsequently cooling and forming the batt into the desiredd thickness The resultant batt, in which fibers are typically bonded to each other at points of contact, possess properties of loft, light-weight, and resilience which are distinctly superior to those of batts made by other processes.

The PVDC-PVC copolymer used in the prior process has adhesive and melt-flow properties which make it superior to all other resins known at the time of the referenced invention. In addition, the particle size of the copolymer, its method of application to the fiberous web, and the subsequent heating and cooling of the batt all contributed to the strength, resilience, and durability of the batt.

While the PVDC-PVC copolymer has the important advantages cited above, it has also some disadvantages. The chemical reactions through which this copolymer is formed require longer reaction times than are necessary to produce some other polymers and copolymers. The efficiency of the reaction at the desired ratios of polyvinylidene chloride to polyvinyl chloride is lower than in many other polymer syntheses and the recovery and separation of unreacted monomer adds to the cost. Also, vinylidene chloride, the major component of this prior copolymer is more expensive than vinyl chloride and certain other monomers.

In the prior process the prior copolymer tends to decompose relatively rapidly at temperatures above 204° C. (400° F.), yielding as one decomposition product hydrochloric acid which causes rust in ovens, cooling chambers, duct work, and even building structures. The prior copolymer produces small amounts of hydrochloric acid even at ambient temperatures, causing rusting of certain metallic surfaces.

Since it is difficult or impossible to avoid temperatures above 204° C. (400° F.) in the commercial production of batts by the prior process, some decomposition of the prior copolymer always occurs. In addition to the problems caused by the release of hydrochloric acid, the prior copolymer itself is discolored by partial decomposition, becoming successively amber colored, brown, and finally black. This makes it impossible to maintain a fully white color in processing certain white fibers into a white end product.

Accordingly, it is an object of the present invention to provide an improved process which utilizes a copolymer having a reduced tendency to decompose under heat and to discolor and to release hydrochloric acid.

It is a further object to utilize a resin or polymer which can be produced more efficiently from less expensive monomers.

It is a still further object to equal or improve on the excellent fiber bonding properties of the prior copolymer.

Yet another object of the present invention is to produce batts which have improved strength, resilience, resistance to compression, and durability.

Another objective is to provide a copolymer which has improved flow properties relative to the prior copolymer and which is available from the reactor in the desired particle-size range, thus eliminating both the cost of grinding or milling the copolymer and eliminating the small, respirable particles which are present in a ground or milled resin.

Other objects and advantages of the present invention will be apparent to those skilled in the art by reference to the following detailed description and drawings wherein:

FIG. 1 is an elevation view of an apparatus suitable for practicing the process of the present invention.

FIG. 2 is a plan view of the apparatus of FIG. 1.

FIG. 3 is a sectional view taken along Line 3—3 of FIG. 2.

The above and other objects are accomplished according to the present invention by providing a completely dry process comprising the steps of:

contacting fibers with an adhesive amount of particles of a copolymer of a diester of a vinyl unsaturated dicarboxylic acid and vinyl chloride; and forming the fibers into a batt; and, heating the batt to a temperature above the melting point of the copolymer but below the scorching or melting point of the fibers; and then cooling the batt.

A wide variety of fibers are useful in the present invention, including both natural and synthetic fibers. Natural fibers include those of cotton, wool, jute, and hemp Synthetic fibers include those of polyester, nylon, acrylic, and rayon. In fact, any fiber or mixture of fibers in which the fiber may be new, unused fibers (virgin fibers) or may be waste fibers reclaimed from garment cuttings, fiber manufacturing, or textile processing, and which do not melt or decompose at temperatures below the melting point of the copolymer can be employed. The preferred fibers are those having a denier of 1 to 22, although finer or coarser fibers may be used.

For reasons explained more completely below, the thin web is generally only from 1 to 200 and preferably from 1 to 100 fibers thick, but because of the loose, open structure of the preferred garnett or card webs the web itself may have an apparent thickness up to one-quarter inch or more.

A wide variety of diesters are useful in the present invention. The alcohol moiety of the diester is preferably lower alkyl. The acid moiety can be any dicarboxylic acid having vinyl unsaturation capable of undergoing an addition polymerization reaction with vinyl chloride. Examples of suitable diesters include among others:

maleic acid, di-isoamyl ester
maleic acid, 2-biphenylyl isobutyl ester
maleic acid, 2-biphenylyl isopropyl ester
maleic acid, bis (1,3-dimethylbutyl) ester maleic acid, bis (2-ethylhexyl) ester
maleic acid, dibutyl ester
maleic acid, diethyl ester
maleic acid, di-cis-9-octadecenyl ester
maleic acid, dioleyl ester
fumaric acid, bis (2-ethylhexyl) ester
fumaric acid, dibutyl ester
maleic acid, di-stearoyl ester
maleic acid, butyl-isoamyl ester.

Maleic acid dibytul ester is preferred because of cost, commercial availability, and reactivity, and because its properties are particularly suitable for the process.

The copolymers useful in the present invention can be graft copolymers, block copolymers, or random copolymers.

The copolymer generally has a weight ratio of diester of a vinyl unsaturated dicarboxylic acid to vinyl chloride of 1:99 to 25:75 and preferably 3:97 to 20:80. When the copolymer has less diester, it performs more nearly like polyvinyl chloride, which produces a soft batt with low strength and resilience. When the copolymer has more diester, the resin itself may be subject to cold-flow phenomena which result in unuseable lumps of resin. An excess of diester also softens the polymer so that batt strength and resilience decline.

The copolymer is applied to the web in an amount sufficient to function as an adhesive and generally in a weight ratio of the copolymer to the fibers of 1:99 to 40:60 and preferably 3:97 to 35:65. The copolymer particles generally have a size range of from 1 to 100 and preferably from 6 to 25 microns and ideally 8 to 12 microns. Smaller sizes than about 5 microns tend to agglomerate into larger clumps and to flow poorly. These smaller particles are also respirable, an undesirable quality. Larger sizes than 12 microns and particularly sizes larger than 25 microns are increasingly inefficient bonding agents and yield soft, weak batts because of the smaller numbers of bonding sites which they provide in the fiber assembly.

Copolymers useful in the present invention have a melting point of from 135° C. to 210° C. (275° F. to 410° F.). Copolymers useful in the present invention are available from Fiberlok, Incorporated, Memphis, Tenn. U.S.A., under the trademark FLEX-LOK ® 021.

The fiberous web is first contacted with the copolymer, forming a horizontally disposed thin, planar assembly of fibers which is then formed into a batt. It is impractical to contact all the fibers in a preformed batt since it is difficult or impossible to ensure uniform penetration of the particles of copolymer into the batt. As used herein, a batt is meant to refer to a plurality of webs, or, as noted, below, similar structures produced by air-lay methods.

The individual fibers of the batt, formed as described above, are then bonded at their intersection by melting and refreezing the copolymer particles.

The batt is heated to a temperature above the melting point of the copolymer but below the scorching or melting point of the fibers and generally at a temperature of 149° to 232° C. (300° to 450° F.) and preferably 163° to 218° C. (325° to 425° F.). At much lower temperatures, the copolymer does not melt whereas at higher temperatures, the fibers are adversely affected The heating is conducted for a time sufficient to effect the desired melting of the copolymer which generally occurs within a period of from ½ to 20 minutes and preferably from 1 to 5 minutes. The batt is then cooled in air whereupon the melted copolymer is refrozen.

Referring now to the drawings and in particular to FIG. 1, there is shown an apparatus 10 useful for practicing the process of the present invention. The apparatus 10 comprises an opener or a garnett 11, a particle dispenser 12, a cross-laying mechanism 13 and, as shown in FIG. 2, an oven 14. The garnett 11 comprises an inlet chute 18 adapted to feed bulk fibers to the rotating drum 19 of the garnett 11. The garnett 11 is also provided with a plurality of toothed rolls 21, 22, 23, 24, 25 which together with the teeth (not shown) on the drum 19 take < bulk fibers 20 and convert them to a web which adheres to the drum 19. The web adhering to the drum 19 is transferred to the drum 28 where it is removed by a comb 29. The web 31 that is now only between 1 and 100 fibers thick and is barely self-supporting enters the particle dispenser 12. While in the particle dispenser 12 the web 31 is contacted with particles 33, 34. Details of the structure and function of the particle dispenser 12 are described in U.S. application Ser. No. 192,344 filed Sept. 30, 1980. Another method of application which performs satisfactorily involves contacting the fibers with the resin after the fibers have been opened and loosened from the compressed bale form and at the stage when they are entrained in an air stream and prior to being deposited on a screen or in the off-take slot of an air-lay system of producing non-woven batts. Air-lay systems of this type are well known in the trade under the names Schirp, Rando Web, DOA, and others.

In the process illustrated here, simply as an example, the web 39 then goes to the conveyor 41 and thence to the conveyor 42. In a manner well known in the art, the lower end of the conveyor 42 is attached to a traveller 43 which moves back and forth on the track 44.

The conveyor 42 is positioned above and at right angles to other conveyor 45. The apparatus is adjusted such that the speed of the conveyor 42 is several times faster than the speed of the conveyor 45. By virtue of this arrangement, the web 39 is cross-laid back and forth on the conveyor 45 thus forming an unheat-treated batt 47. The unheat-treated batt 47 passes between an upper foraminous belt 49 and a lower foraminous belt 50 (see FIG. 3). While held between the belts 49, 50, the unheat-treated batt 47 passes into the oven 14. As shown in FIG. 3, the oven 14 is provided with heating means 52 in which temperature can be controlled by a thermostat 53. The oven 14 is also provided with air circulating means not shown that causes the air to circulate in the direction shown by the arrows 55 and 56. The resultant product is the final heat-treated batt 58.

The invention may be understood by reference to the following non-limiting examples. These examples are designed to teach those skilled in the art how to practice the invention and represent the best mode contemplated for practicing the invention. Unless otherwise specified, all parts and percentages are by weight.

EXAMPLE 1

This example is illustrative of the present invention. A batt is produced employing the apparatus shown in the attached Figures.

The oven temperature was 210° C. (410° F.). The residence time in the oven was 3 minutes. The ratio of resin to fiber was 15 to 85. The resin is a copolymer of maleic acid dibutyl ester and vinyl chloride in a weight ratio of 5:95. The copolymer has a melting point of 190° C. (374° F.), and a particle size of 22 microns. This product is available from Fiberlok, Inc. of Memphis, Tenn. U.S.A. under the trademark FLEX-LOK ® 021.

The resultant batt is tested according to ASTM Test No. D-1682 to determine its tensile strength and the results recorded in Column 4 of the table. The compression strength is measured according to ASTM Test No. D-1777 using a 211 gm/cm$^2$ weight (3 lb/in$^2$) and the results recorded in Column 7 of the table. The percent recovery is measured according to ASTM Test No. D-1777 after one hour from the 211 gm/cm$^2$ compression and the results recorded in Column 8 of the table. The firmness is measured by the bending length of a strip of batt 38.1 cm (15 in) long by 7.62 cm (3 in) wide by 1.91 cm (¾ in) thick projected over a drop of 15.24 cm (6 inches) and the results recorded in Column 9 of the table.

EXAMPLE 2

This example is not illustrative of the present invention but of the prior art. The procedure of Example 1 was repeated except that the resin was replaced with a copolymer of vinylidene chloride and vinyl chloride in which the ratio of vinyl chloride to vinylidene chloride is 10:90. The particle size of the dry resin has been reduced by air-jet pulverizing to 12 microns. The melting point is 165° C. (329° F.).

EXAMPLE 3

This example is not illustrative of the present invention. The procedure of Example 1 is repeated except that the resin is replaced with a polyvinyl chloride resin homopolymer (PVC) in which the particle size is 2 microns. The melting point is 180° C. (326° F.).

EXAMPLE 4

This example is not illustrative of the present invention. The procedure of Example 1 is repeated except that the resin is replaced by an ethylene vinyl acetate resin (EVA) in which the particle size is 20 microns and the melting point is 135° C. (275° F.) and the ratio of vinyl acetate to ethylene is 40:60.

EXAMPLE 5

This example is not illustrative of the present invention. The procedure of Example 1 is repeated except that the resin is replaced with an interpolymer of vinylidene chloride, vinyl chloride, and vinyl acetate (PVDC-PVC-PVA) in which the melting point is 135° C. (275° F.) and the resin particles have been air-jet pulverized to 12 microns in size.

EXAMPLE 6

This example is not illustrative of the present invention. The procedure of Example 1 is repeated except that the resin is replaced with a polyethylene resin (PE) in which the melting point is 140° C. (284° F.) and the resin particles are approximately 100 microns in size.

EXAMPLE 7

This example illustrates the desirably low level of hydrochloric acid release of the present invention compared to the prior art.

The batt containing 5 grams of the copolymer of vinyl chloride and the dibutyl ester of maleic acid produced in accordance with Example 1 is heated to 225° C. (437° F.) for 15 minutes in an air stream. The hydrochloric acid given off is dissolved in water and the resultant solution titrated for hydrochloric acid whereupon 0.031 grams are found.

EXAMPLE 8

This example illustrates the undesirably high level of hydrochloric acid release in prior batts employing PVDC-PVC copolymer.

The procedure of Example 7 is repeated except that the batt of Example 1 is replaced with the batt of Example 2 which contains 5 grams of the PVDC-PVC copolymer. The hydrochloric acid released is 0.210 grams.

TABLE

| 1. Example | 2. Inventive (I) or Comparative (C) | 3. Polymer | 4. Tensile Strength (kg/cm$^2$) | 5. Smoke in Process | 6. Color | 7. Compression Strength (%) | 8. Recovery from Compression (%) | 9. Firmness (cm) |
|---|---|---|---|---|---|---|---|---|
| 1 | I | PVC—dibutyl ester | 3.18 | Very Light | Natural | 58 | 95.8 | 34.0 |
| 2 | C | PVDC—PVC | 1.99 | Heavy | Brown | 51 | 94.4 | 26.2 |
| 3 | C | PVC | 1.20 | Light | Natural | 57 | 94.9 | 18.5 |
| 4 | C | EVA | 1.50 | Light | Natural | 53 | 94.7 | 18.3 |
| 5 | C | PVDC—PVC—PVA | 2.06 | Moderate to Heavy | Light Brown | 58 | 93.0 | 24.9 |
| 6 | C | PE | 0.95 | Very Heavy | Natural | 45 | 89.9 | 11.4 |

The results of the experiments clearly show the advantages of the present invention over the prior art and over the other polymers tested. Tensile strength is over 50% greater comparing Examples 1 and 5. Firmness is over 30% greater comparing Examples 1 and 2. Furthermore as shown in Examples 6 and 7 the amount of hydrochloric acid is reduced to approximately one-sixth.

An important object of this invention, as noted above, is to overcome the problems caused by the decomposition of the PVDC-PVC copolymer and the release of hydrochloric acid which causes rusting and corrosion of the processing equipment, including the oven and cooling system, ductwork, metal roofs, and other machinery, and even vegetation outside the factories when the effluent from the oven is not captured and neutralized.

Although the invention has been described in considerable detail with reference to certain preferred embodiments thereof, it will be understood that variations and modifications can be effected within the spirit and scope of the invention as described above and as defined in the appended claims.

What is claimed is:

1. A fibrous batt, the individual fibers of which are bonded at their intersection by melted and refrozen particles of a copolymer of vinyl chloride and a diester of vinyl unsaturated dicarboxylic acid wherein the diester is maleic acid dibutyl ester.

2. A fiberous batt of high compressive strength, the individual fibers of which are bonded at their intersection by melted and refrozen particles of a copolymer of vinyl chloride and a diester of vinyl unsaturated dicarboxylic acid;

wherein the fibers have a fiber denier from 1 to 22; and wherein the weight ratio of vinyl unsaturated dicarboxylic acid to vinyl chloride is 3:97 to 20:80; and wherein the weight ratio of the copolymer to the fibers is 3:97 to 35:65; and wherein the copolymer particles have a size range of 6 to 25 microns; and wherein the copolymer has a melting point of 135° to 190° C.; and wherein the diester is dibutyl maleate.

* * * * *